US008745870B2

(12) United States Patent
Kawamura et al.

(10) Patent No.: US 8,745,870 B2
(45) Date of Patent: Jun. 10, 2014

(54) REGENERATED ELASTIC ROLLER MANUFACTURING PROCESS, REGENERATED ELASTIC ROLLER, ELECTROPOHOTOGRAPHIC PROCESS CARTRIDGE, AND ELECTROPOHOTOGRAPHIC IMAGE FORMING APPARATUS

(75) Inventors: Kunimasa Kawamura, Suntou-gun (JP); Masahiro Watanabe, Mishima (JP); Kazuaki Nagaoka, Sunono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/447,097

(22) Filed: Apr. 13, 2012

(65) Prior Publication Data

US 2012/0195649 A1 Aug. 2, 2012

Related U.S. Application Data

(60) Division of application No. 12/179,018, filed on Jul. 24, 2008, now Pat. No. 8,176,632, which is a continuation of application No. PCT/JP2008/051139, filed on Jan. 21, 2008.

(30) Foreign Application Priority Data

Jan. 22, 2007 (JP) ..... 2007-011914
Jan. 17, 2008 (JP) ..... 2008-008346

(51) Int. Cl.
*B21K 1/02* (2006.01)
*G03G 21/00* (2006.01)

(52) U.S. Cl.
USPC ..... 29/895.1; 399/357; 399/345; 399/343; 15/256.52; 15/256.51; 101/425

(58) Field of Classification Search
USPC ..... 29/895.1; 101/425; 399/343, 345, 347, 399/349, 357; 15/256.52, 256.51
See application file for complete search history.

(56) References Cited

U.S. PATENT DOCUMENTS 3,861,860 A 1/1975 Thettu et al.
3,924,901 A 12/1975 Phillips (Continued)

FOREIGN PATENT DOCUMENTS

EP 0 288 175 A1 10/1988
GB 1464759 A 2/1977

(Continued)

OTHER PUBLICATIONS

PCT Notification Concerning Transmittal of International Preliminary Report on Patentability (Form PCT/IB/326); PCT Including Written Opinion of the International Searching Authority (Form PCT/ISA237)—(10 pages), dated Aug. 6, 2009.

(Continued)

*Primary Examiner* — Essama Omgba
(74) *Attorney, Agent, or Firm* — Fitzpatrick, Cella, Harper and Scinto

(57) ABSTRACT

A regenerated elastic rollers manufacturing process is provided. The process includes the step of removing an agglutinated stain of toner adhered to the surface of an elastic roller including a mandrel and an elastic layer. The step further includes the steps of: (1) pressing a pressing roller against the surface of the elastic roller so as to crack the agglutinated stain on the surface of the elastic roller; and (2) removing the agglutinated stain cracked in the step (1) from the surface of the elastic roller by means of an adhesive roller.

3 Claims, 6 Drawing Sheets

(56) References Cited

U.S. PATENT DOCUMENTS

| | | | | |
|---|---|---|---|---|
| 4,018,555 | A | 4/1977 | Thettu | |
| 4,111,546 | A | 9/1978 | Maret | |
| 4,739,370 | A | 4/1988 | Yoshida et al. | |
| 5,043,760 | A | 8/1991 | MacLellan et al. | |
| 5,148,227 | A | 9/1992 | Senba et al. | |
| 5,175,591 | A | 12/1992 | Dunn et al. | |
| 5,275,104 | A | 1/1994 | Corrado et al. | |
| 5,678,134 | A | 10/1997 | Miki et al. | |
| 5,678,153 | A | 10/1997 | Okamoto et al. | |
| 5,685,043 | A | 11/1997 | LaManna et al. | |
| 6,026,271 | A | 2/2000 | Saitoh | |
| 6,148,831 | A | 11/2000 | Lindstrom et al. | |
| 6,192,214 | B1 | 2/2001 | Kim et al. | |
| 6,360,073 | B1 | 3/2002 | Eelen | |
| 6,463,254 | B1 | 10/2002 | Maul et al. | |
| 7,481,164 | B2 | 1/2009 | Mori | |
| 7,664,453 | B2 | 2/2010 | Morishita | |
| 7,702,275 | B2 | 4/2010 | Morishita | |
| 7,907,885 | B2 | 3/2011 | Thayer | |
| 8,176,632 | B2 * | 5/2012 | Kawamura et al. | 29/895.1 |
| 2002/0009316 | A1 | 1/2002 | Endo et al. | |
| 2010/0150629 | A1 | 6/2010 | Thayer | |
| 2011/0064495 | A1 | 3/2011 | Tanaka | |
| 2012/0076530 | A1 * | 3/2012 | Aoyagi et al. | 399/100 |

FOREIGN PATENT DOCUMENTS

| | | | |
|---|---|---|---|
| JP | 63-151982 | A | 6/1988 |
| JP | 04-336582 | | 11/1992 |
| JP | 06-027833 | | 2/1994 |
| JP | 07-175255 | | 7/1995 |
| JP | 08-328375 | | 12/1996 |
| JP | 08-328442 | | 12/1996 |
| JP | 09-101659 | | 4/1997 |
| JP | 2000-62223 | A | 2/2000 |
| JP | 2000-221725 | | 8/2000 |
| JP | 2003-195674 | A | 7/2003 |
| JP | 2007-4044 | A | 1/2007 |

OTHER PUBLICATIONS

European Search Report dated Aug. 21, 2013 in European Application No. 08703951.7.

Indian Office Action dated Dec. 6, 2013 in Indian Application No. 6393/CHENP/2008.

* cited by examiner

REGENERATED ELASTIC ROLLER MANUFACTURING PROCESS, REGENERATED ELASTIC ROLLER, ELECTROPOHOTOGRAPHIC PROCESS CARTRIDGE, AND ELECTROPOHOTOGRAPHIC IMAGE FORMING APPARATUS

This application is a divisional of U.S. application Ser. No. 12/179,018 filed on Jul. 24, 2008, which is a continuation of International Application No. PCT/JP2008/051139 filed on Jan. 21, 2008, which claims the benefit of Japanese Patent Application No. 2007-011914 filed on Jan. 22, 2007 and Japanese Patent Application No. 2008-008346 filed on Jan. 17, 2008.

BACKGROUND OF THE INVENTION

1. Field of the Invention

This invention relates to a regenerated elastic roller manufacturing process by which elastic rollers having been used in image forming apparatuses utilizing an electrophotographic system, such as copying machines, laser beam printers, facsimile machines and printing machines, can be recovered. This invention also relates to a regenerated elastic roller, and an electrophotographic process cartridge and an electrophotographic image forming apparatus both of which use the regenerated elastic roller.

2. Description of the Related Art

In the image forming apparatus utilizing an electrophotographic system, such as electrophotographic apparatus, as a developing roller, a charging roller, a transfer roller, a fixing roller or a cleaning roller, an elastic roller comprising an elastic layer as a surface layer, hereinafter called as a "surface-elastic roller", is used. To the outer peripheral surface of the surface-elastic roller, toners, external additives and so forth making up developers adhere and are gradually deposited while being used. In the image forming apparatus, the surface of the surface-elastic roller is usually cleaned with cleaning means of various types (see Japanese Patent Applications Laid-Open No. H09-101659 and No. H04-336582). However, it has come about that, when being used over a long period of time, developer components such as toners, external additives and so forth which have been unable to be removed by cleaning means are adhered and agglutinated in some cases to the surface of the surface-elastic roller. In particular, there is a remarkable tendency in a developing roller that crushed toners are agglutinated on the surface thereof. Hereinafter, the agglutinated matters on the surface of the surface-elastic roller are called an "agglutinated stain of a developer origin" or simply an "agglutinated stain".

Such an agglutinated stain of developer origin is difficult to remove with such cleaning means as disclosed in the above Japanese Patent Applications Laid-Open No. H09-101659 and No. H04-336582.

However, from the viewpoint of reducing an environmental load, there is a growing need for developing a technique that enables the surface-elastic roller on the surface of which the agglutinated stain is formed to be re-applied for forming a high-grade electrophotographic images. Japanese Patent Application Laid-Open No. H08-328375 discloses a technique in which a filming on a developing roller having been used is removed to regenerate the developing roller. More specifically, it discloses a method in which the surface of a developing roller having been used is surface-processed with a tape abrasive, water jets or a grinding stone to regenerate the developing roller.

SUMMARY OF THE INVENTION

Problem to be Solved by the Invention

However, the method disclosed in the above Japanese Patent Application Laid-Open No. H08-328375 is basically a method of scraping off the agglutinated stain of a developer origin. According to the present inventors' study, when the method is applied to a surface-elastic roller, it has come about in some case that the surface of its elastic layer is damaged or scratched. If a charging roller or a developing roller has irregular scratches or the like on the surface thereof, it may cause non-uniform charging or non-uniform development to affect the grade of images.

Accordingly, an object of the present invention is to provide a process of manufacturing a regenerated elastic roller which can be reused as various elastic rollers of an image forming apparatus utilizing an electrophotographic process.

Another object of the present invention is to provide an electrophotographic process cartridge and an electrophotographic image forming apparatus which enable effective utilization of resources to be promoted by the use of the regenerated elastic roller obtained.

Means for Resolving the Problem

The regenerated elastic roller manufacturing process according to the present invention includes the step of removing an agglutinated stain of a developer origin adhered to the surface of an elastic roller provided with a mandrel and an elastic layer as a surface layer, which includes the steps of: (1) pressing a pressing roller against the surface of the elastic roller so as to crack the agglutinated stain on the surface of the elastic roller; and (2) removing the agglutinated stain cracked in the step (1) from the surface of the elastic roller by means of an adhesive roller.

The regenerated elastic roller according to the present invention is characterized in that it has been manufactured by the above regenerated elastic roller manufacturing process.

Further, the electrophotographic process cartridge according to the present invention includes a photosensitive member on which an electrostatic latent image is to be formed, a charging member which charges the photosensitive member and a developing member which develops the electrostatic latent image held on the photosensitive member, and is detachably mountable on the main body of an electrophotographic image forming apparatus, wherein at least one of the charging member and the developing member is the above regenerated elastic roller.

Furthermore, the electrophotographic image forming apparatus according to the present invention includes a photosensitive member on which an electrostatic latent image is to be formed, a charging member which charges the photosensitive member and a developing member which develops the electrostatic latent image held on the photosensitive member, wherein at least one of the charging member and the developing member is the above regenerated elastic roller.

According to the present invention, the agglutinated stain can be removed from the surface of the surface-elastic roller without physically damaging the elastic rollers and without impairing the properties, and as the result of that, a regenerated elastic roller, which can be reused as various elastic rollers of an image forming apparatus utilizing an electrophotographic process, is obtained. In addition, the electrophotographic process cartridge and electrophotographic image forming apparatus of the present invention can promote effective utilization of resources.

DESCRIPTION OF THE EMBODIMENTS

Figure 1A:
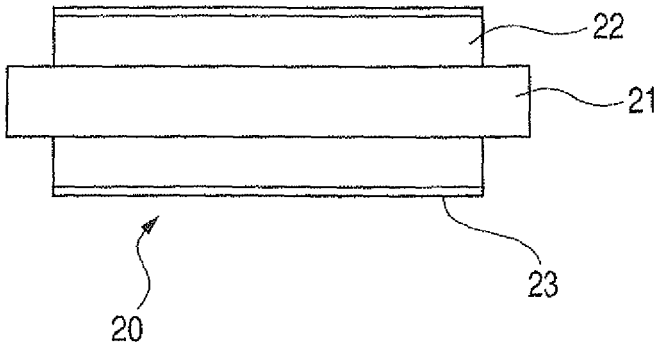
FIG. 1A is a schematic sectional view of an example of an elastic roller in its axial direction, used in the regenerated elastic roller manufacturing process of the present invention.

The regenerated elastic roller manufacturing process according to the present invention has the step of removing an agglutinated stain of a developer origin adhered to the surface of an elastic roller provided with a mandrel and an elastic layer as a surface layer.

That step includes the following steps (1) and (2):

(1) pressing a pressing roller against the surface of the elastic roller so as to crack the agglutinated stain on the surface of the elastic roller; and (2) removing the agglutinated stain cracked in the step (1) from the surface of the elastic roller by means of an adhesive roller.

The present inventors have discovered that the agglutinated stain can be removed from the surface-elastic roller without damaging the elastic roller by applying a load with a pressing roller to the surface-elastic roller on the surface of which the agglutinated stain of a developer origin is adhered because of repetitive use for the electrophotographic process, and then, contacting an adhesive roller comprising an adhesive layer with the surface of the elastic roller.

As to the reason why the agglutinated stain of a developer origin can efficiently be removed by the above process, and as the result, a high-grade regenerated elastic roller can be obtained, the present inventors consider the following:

Most of the agglutinated stain of a developer origin that has been formed on the elastic roller surface is pressed against the electrophotographic photosensitive member or the like to come into a laminar agglutinated stain, which adheres strongly to the surface of the elastic roller. Hence, if the adhesive roller is merely used, the agglutinated stain cannot sufficiently be removed when the adhesive force of the agglutinated stain to the elastic roller surface is stronger than the adhesive force of the agglutinated stain to the adhesive roller. However, pressure is applied to the elastic roller surface to locally deform the elastic roller, whereupon the agglutinated stain whose flexibility is lower as compared with the elastic roller can no longer follow the deformation of the elastic roller and is broken, so that the agglutinated stain on the surface is cracked. The cracked agglutinated stain is reduced in the adhesive force to the elastic roller. Hence, the agglutinated stain is considered to be efficiently removed by means of the adhesive roller.

Herein, the "crack(s)" referred to in the present invention is defined as a crack(s) of the agglutinated stain that is(are) not seen before passing through the step (1), but is(are) seen after passing through the step (1), when the agglutinated stain on the elastic roller surface is observed with a scanning electron microscope (SEM) at 5,000 magnifications.

According to studies made by the present inventors, cracking the agglutinated stain on the elastic roller in this way has been found to be very important in removing the agglutinated stain in the step of transfer the agglutinated stain to the surface of the adhesive roller according to the step (2).

—Elastic Roller—

The elastic roller to be recovered in the regenerated elastic roller manufacturing process according to the present invention is of various types set in the electrophotographic image forming apparatus utilizing an electrophotographic process. Specifically, the elastic roller includes developing rollers, charging rollers, transfer rollers, fixing rollers and cleaning rollers. Such an elastic roller has a mandrel and an elastic layer which is a surface layer formed on the periphery of the mandrel.

Mandrel:

The mandrel supports the elastic layer and so forth on its periphery and has a strength large enough to withstand a load applied in the electrophotographic process. The mandrel may have any shape such as a column or a cylinder.

The material of the mandrel includes carbon steel, alloy steel, cast iron and conductive resins where the elastic roller is required to have electrical conductivity.

Specific examples of the alloy steel includes stainless steel, nickel chromium steel, nickel chromium molybdenum steel, chromium steel, chromium molybdenum steel, and nitriding steel to which Al, Cr, Mo and V have been added.

The mandrel may have been subjected to plating or oxidation treatment as a measure for antirust. The type of plating includes electroplating and electroless plating. The electroless plating is preferred from the viewpoint of dimensional stability. As the electroless plating, the following may be used: nickel plating such as Ni—P, Ni—B, Ni—W—P or Ni—P—PTFE composite plating, copper plating, gold plating, Kanigen plating, and other alloy plating of various types. The deposit thickness in the plating is preferably 0.05 μm or more, and more preferably from 0.1 μm to 30 μm.

Elastic Layer:

The elastic layer is provided in order to provide the elastic roller with elasticity required in the apparatus to be used. The elastic layer may specifically be made up of any of a solid member and a foamed member. The elastic layer may also be composed of a single layer or a plurality of layers. For example, the developing roller is always in contact with a photosensitive drum, a developer control blade and a toner, and hence, is provided with the elastic layer so as to lessen damage occurring between these members and to achieve low hardness and low compression set.

A material for the elastic layer includes, e.g., natural rubber, isoprene rubber, styrene rubber, butyl rubber, butadiene rubber, fluoro-rubber, urethane rubber and silicone rubber. Any of these may be used singly or in a combination of two or more.

Conductive Agent, Etc:

The elastic layer may be incorporated with a conductive agent, nonconductive filler and, as other various additive components necessary for molding, a cross-linking agent, a catalyst, a dispersion promoter and so forth, in accordance with the performance required for the elastic roller.

As the conductive agent, the following may be used: various conductive metals or alloys, conductive metal oxides, electron-conductive agents such as fine insulating material powders coated with these, and ion-conductive agents.

The ion-conductive agents may be exemplified by the following.

Salts of Group 1 metals of the periodic table, such as $LiCF_3SO_3$, $NaClO_4$, $LiClO_4$, $LiAsF_6$, $LiBF_4$, NaSCN, KSCN and NaCl; ammonium salts such as $NH_4Cl$, $(NH_4)_2SO_4$ and $NH_4NO_3$; salts of Group 2 metals of the periodic table, such as $Ca(ClO_4)_2$ and $Ba(Clo_4)_2$; complexes of these salts with polyhydric alcohols such as 1,4-butanediol, ethylene glycol, polyethylene glycol, propylene glycol or polypropylene glycol, or with derivatives of these; complexes of these salts with monohydric alcohols such as ethylene glycol monomethyl ether, ethylene glycol monoethyl ether, polyethylene glycol monomethyl ether or polyethylene glycol monoethyl ether; cationic surface-active agents such as quaternary ammonium salts; anionic surface-active agents such as aliphatic sulfonates, alkyl sulfuric ester salts and alkyl phosphoric ester salts; and amphoteric surface-active agents such as betaine.

The electron-conductive agents may be exemplified by the following.

Carbon type materials such as carbon black and graphite; metals or alloys, such as aluminum, silver, gold, a tin-lead alloy and a copper-nickel alloy; metal oxides such as zinc oxide, titanium oxide, aluminum oxide, tin oxide, antimony oxide, indium oxide and silver oxide; and materials obtained by subjecting fillers of various types to conductive metal plating with use of copper, nickel or silver.

Any of these conductive agents may be used singly or in a combination of two or more, in the form of powder or fiber. Of these, carbon black is preferred because conductivity is easily controlled and is economical.

Incorporation of such a conductive agent enables the elastic layer to have, e.g., a volume resistivity of from $1\times10^4$ to $1\times10^{10}$ Ω·cm. A developing roller the elastic layer of which has volume resistivity within this range has uniform charge controllability for toners. The elastic layer of the developing roller preferably has a volume resistivity of from $1\times10^4$ to $1\times10^9$ Ω·cm.

Examples of the non-conductive filler include the following: Diatomaceous earth, quartz powder, dry-process silica, wet-process silica, titanium oxide, zinc oxide, aluminosilicic acid, calcium carbonate, zirconium silicate, aluminum silicate, talc, aluminum oxide, and iron oxide.

The elastic layer has elasticity required for the elastic roller, and preferably has, e.g., an Asker-C hardness of 10 degrees or more and 80 degrees or less. As long as the elastic layer has an Asker-C hardness of 10 degrees or more, any oil components can be kept from oozing out of the rubber material making up the elastic layer, and the photosensitive drum can be kept from being contaminated. As long as the elastic layer has an Asker-C hardness of 80 degrees or less, toners can effectively be kept from deteriorating, and reproduced images can be inhibited from decreasing in image quality.

The Asker-C hardness herein referred to may be defined by the value measured with an Asker rubber hardness meter (manufactured by Kobunshi Keiki Co., Ltd.), using a test piece prepared separately according to a reference standard Asker-C Type SRIS (Japan Rubber Association Standard) 0101.

The elastic layer is preferably in a thickness of 0.5 mm or more and 50 mm or less, and more preferably 0.5 mm or more and 10 mm or less, in the case of, e.g., the developing roller.

The method of forming the elastic layer includes, e.g., a method in which an uncured elastic layer material is heat-cured by any one of various types of molding methods, such as extrusion, press molding, injection molding, liquid injection molding or cast molding, at a suitable temperature for a suitable time to form the elastic layer on the mandrel. The uncured elastic layer material may be injected into a cylindrical mold with the mandrel set therein and then heat-cured, whereby the elastic layer can be formed in a high precision on the periphery of the mandrel.

—Functional Layer—

The elastic roller may be provided with one or two or more types of functional layers over or under the elastic layer so as to have functionality as required.

The functional layer includes a surface layer which protects the elastic roller surface, provides the surface with wear resistance and keeps toners from adhering thereto.

Examples of a binder resin for the surface layer include the following: Epoxy resins, diallyl phthalate resins, polycarbonate resins, fluorine resins, polypropylene resins, urea resins, melamine resins, silicon resins, polyester resins, styrol type resins, vinyl acetate resins, phenolic resins, polyamide resins, cellulose type resins, urethane resins, silicone resins, acrylic urethane resins, and emulsion resins; a combination of two or more selected from these.

Of these, nitrogen-containing resins such as urethane resins and acrylic urethane resins are preferred. This is because, in the case of the developing roller, toners can stably be charged, toners can be kept from adhering as being of low tackiness, and further toners are easy to release.

The urethane resins used here are obtained from isocyanate compounds and polyols.

Where a surface layer containing a urethane resin as the binder resin is formed on the elastic layer, it is preferable that the surface of the elastic layer is irradiated with ultraviolet rays and thereafter a coating film is formed from a coating solution containing an uncured resin material. Hydroxyl groups that form chemical bonds with the isocyanate included in the urethane resin can be easily generated by irradiation with ultraviolet rays to obtain a strong linkage between a urethane resin layer and the elastic layer.

Examples of the isocyanate include the following: Diphenylmethane-4,4'-diisocyanate, 1,5-naphthalene diisocyanate, 3,3'-dimethylbiphenyl-4,4'-diisocyanate, 4,4'-dicyclohexylmettane diisocyanate, p-phenylene diisocyanate, isophorone diisocyanate, carbodimide modified MDI, xylylene diisocyanate, trimethylhexamethylene diisocyanate, tolylene diisocyanate, naphthylene diisocyanate, paraphenylene diisocyanate, hexamethylene diisocyanate, and polymethylene polyphenyl polyisocyanate. Any of these may be used singly or in a combination of two or more.

Examples of the polyol include the following: As dihydric polyols (diols), ethylene glycol, diethylene glycol, propylene glycol, dipropylene glycol, 1,4-butanediol, hexanediol, neopentyl glycol, 1,4-cyclohexanediol, 1,4-cyclohexanedimethanol, xylene glycol, and triethylene glycol; as trihydric or higher polyols, 1,1,1-trimethylolpropane, glycerol, pentaerythritol, and sorbitol; and further polyols such as high molecular weight polyethylene glycols obtained by addition of ethylene oxide or propylene oxide to diols or triols, polypropylene glycol, ethylene oxide-propylene oxide block glycol. Any of these may be used in combination, where the mixing proportion thereof may appropriately be determined.

As these urethane resins, it is preferable to use as a main component a resin obtained by mixing a polyurethane prepolymer having a hydroxyl group at least at the terminal and a block isocyanate in a proportion of from 1.1 to 1.5 in NCO equivalent weight (the value of [NCO]/[OH]) and allowing them to react. As long as the NCO equivalent weight is 1.1 or more, the surface layer can have adhesion to the elastic layer and can be inhibited from being damaged against repeated regeneration processing. As long as the NCO equivalent weight is 1.5 or less, the surface layer can be kept from having a high hardness and the agglutinated stain of toner is made readily removable because of the effect of pressing the pressing roller.

The surface layer may contain a conductive agent in order to control the electrical resistance of the elastic roller. The conductive agent the surface layer may contain is specifically exemplified by the same ones as exemplified as the conductive agent used in the elastic layer.

The surface layer is preferably in a thickness of from 1 μm to 500 μm, and more preferably from 1 μm to 50 μm. As long as the surface layer is in a thickness of 1 μm or more, the elastic roller can be inhibited from deteriorating because of wear or the like, and comes to be superior in durability. As long as the surface layer has a thickness of 500 μm or less, the elastic roller surface can be inhibited from having a high hardness and from deteriorating, and toners can be inhibited from melt-adhering to the surface.

As a method for forming the surface layer, a method is available in which, e.g., a coating solution containing an uncured resin is prepared and the surface layer is formed by coating such as dipping, roll coating, ring coating or spraying.

Surface Roughness (Ra):

Such an elastic roller preferably has a surface roughness Ra of 0.05 μm or more and 2.5 μm or less. This is to make the agglutinated stain easily removable and, in the case of the developing roller, to make toners easily transportable. As long as the elastic roller has a surface roughness of 0.05 μm or more, toner transport power is ensured, and ghosts or density non-uniformity are inhibited from occurring in virtue of sufficient image density, to thereby obtain high-quality images. As long as the elastic roller has a surface roughness of 2.5 μm or less, the contact area with the adhesive roller is ensured to make the agglutinated stain readily removable.

In order to provide the elastic roller with such surface roughness, fine particles having a volume average particle diameter of from 1 μm to 20 μm may be dispersed therein. As such fine particles, the following may be used: plastic pigments of fine polymethyl methacrylate particles, fine silicone rubber particles, fine polyurethane particles, fine polystyrene particles, fine amino resin particles or fine phenol resin particles.

The surface roughness Ra may be defined by the value measured with a contact surface roughness meter SURFCOM 480A (manufactured by Tokyo Seimitsu Co., Ltd.) according to the standard of JIS B 0601:1994 surface roughness. Specifically, using a stylus of 2 μm in radius, measurement is made at three spots in the peripheral direction for each of three spots in the axial direction (nine spots in total) under conditions of a pressing pressure of 0.7 mN, a measuring rate of 0.3 mm/sec, a measuring magnification of 5,000 times, a cut-off wavelength of 0.8 mm and a measuring length of 2.5 mm. An average value of these is adopted as the surface roughness Ra.

Hardness:

The hardness of the elastic roller may be selected in relation to the hardness of the pressing roller and adhesive roller, and is preferably 20 degrees or more and 80 degrees or less in Asker-C hardness, and more preferably 30 degrees or more and 70 degrees or less, in order to make the agglutinated stain readily removable.

The size of the elastic roller may be selected in relation to the diameters of the pressing roller and adhesive roller, and is preferably 4 mm or more and 200 mm or less in diameter in order to make the agglutinated stain readily removable.

Figure 1B:
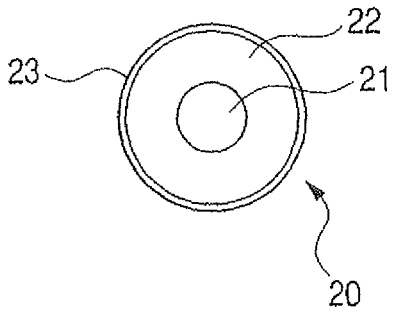
FIG. 1B is a schematic sectional view of an example of the elastic roller in the direction crossing at right angles to its axis, used in the regenerated elastic roller manufacturing process of the present invention.

Examples of such an elastic roller specifically include what are shown in FIGS. 1A and 1B. FIG. 1A is a sectional view of the elastic roller in its axial direction. FIG. 1B is a sectional view of the elastic roller in the direction crossing at right angles to its axis. As shown in FIGS. 1A and 1B, an elastic roller 20 has a mandrel 21 and provided thereon an elastic layer 22 and a surface layer 23 in this order formed on the mandrel 22. The elastic layer and the surface layer may have not only a single-layer structure but also a multi-layer structure.

Next, the regenerated elastic roller manufacturing process according to the present invention is described in detail.

Step (1)

The step (1) in the regenerated elastic roller manufacturing process according to the present invention is a step of pressing a pressing roller against the elastic roller to apply pressure thereto. Thereby, the elastic roller is deformed locally to crack the agglutinated stain which has hardness high enough not to follow such deformation.

Thus, the adhesive force of the agglutinated stain to the elastic roller is made lower than the adhesive force of the agglutinated stain to the adhesive roller.

Herein, as defined previously, the "cracks" refer to cracks of the agglutinated stain that are not seen before passing through the step (1), but are seen after passing through the step (1), when the agglutinated stain on the elastic roller surface is observed with a scanning electron microscope (SEM) at 5,000 magnifications.

According to studies made by the present inventors, cracking the agglutinated stain on the elastic roller in this way has been found to be very important in removing the agglutinated stain in the step of transfer the agglutinated stain to the surface of the adhesive roller according to the step (2).

The pressing roller used in the step (1) preferably has an elastic layer on the periphery of a mandrel.

It is preferable for the mandrel of the pressing roller to have strength high enough to be durable to the pressure at which a load is repeatedly applied to the elastic roller. The mandrel may be composed of metal or plastics. The material of the mandrel includes the same materials as exemplified for the elastic roller.

The elastic layer of the pressing roller presses and deforms the elastic roller surface. The material thereof may be a metallic, plastic or rubber material, but a relatively high-hardness rubber material is preferred which can efficiently break the agglutinated stain of toner on the surface without damaging the elastic roller surface. Specifically, it may include natural rubber, isoprene rubber, styrene rubber, butyl rubber, butadiene rubber, fluororubber, urethane rubber and silicone rubber.

In order to efficiently break the agglutinated stain of toner on the elastic roller surface, the pressing roller preferably has hardness higher than the hardness of the elastic roller so as to press and deform the elastic roller. Specifically, it is preferable that the pressing roller has an Asker-C hardness of 40 degrees or more and 90 degrees or less.

In order to efficiently break the agglutinated stain of toner on the elastic roller surface, the pressing roller preferably has surface roughness Ra which is set to be as large as possible in a range in which the elastic roller is not damaged. Specifically, the surface roughness Ra of the pressing roller is 0.1 μm or more and 5 μm or less.

The surface roughness Ra of the pressing roller can be brought into the desired value by sanding the surface by means of a cylindrical sander while controlling its sanding time. It is also effective that fine particles having a volume average particle diameter of from 1 μm to 20 μm are dispersed in the pressing roller. Such fine particles include the same fine particles as exemplified for the elastic roller described above.

In order to efficiently break the agglutinated stain on the elastic roller surface, the pressing roller preferably has a diameter smaller than the diameter of the elastic roller so as to increase the pressure at which a load is applied to the elastic roller. Specifically, the pressing roller preferably has a diameter of 1 mm or more and 10 mm or less.

In the step (1), the pressure at which the pressing roller is pressed against the elastic roller to apply a load thereto is preferably 10 N/m or more and 5,000 N/m or less, and particularly preferably 100 N/m or more and 3,000 N/m or less, in drawing pressure.

As long as the drawing pressure at which a load is applied to the elastic roller is 10 N/m or more, the agglutinated stain of a developer origin on the elastic roller surface can efficiently be broken. As long as the drawing pressure is 5,000 N/m or less, the elastic roller can be kept from being damaged at the time of pressing in the step (1).

Herein, the drawing pressure may be measured by the following method. A SUS stainless steel sheet of 30 μm in thickness to be drawn is interposed between two SUS stainless steel sheets of 30 μm in thickness, and these are inserted into the contact part where the pressing roller and the elastic roller are brought into contact with each other. Next, the SUS stainless steel sheet to be drawn is pulled, where the force of drawing at a rate of about 0.5 cm/sec is measured. The value corresponding to linear pressure converted into force per 1 m of the width of the SUS stainless steel sheet is defined as the drawing pressure.

The force of drawing is measured with a digital force gauge (trade name: DS2, manufactured by IMADA Co., Ltd.).

Figure 2A:
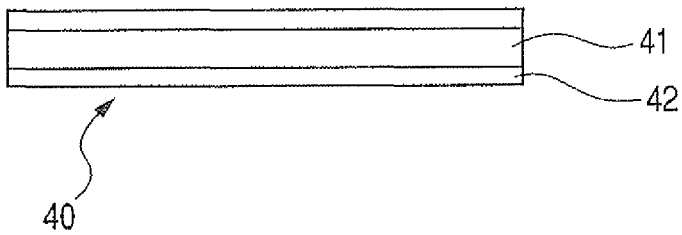
FIG. 2A is a schematic sectional view of an example of a pressing roller in its axial direction, used in the regenerated elastic roller manufacturing process of the present invention.
Figure 2B:
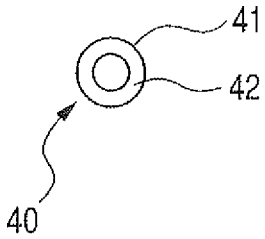
FIG. 2B is a schematic sectional view of an example of the pressing roller in the direction crossing at right angles to its axis, used in the regenerated elastic roller manufacturing process of the present invention.

An example of such a pressing roller specifically includes what is shown in FIGS. 2A and 2B. FIG. 2A is a schematic sectional view of the pressing roller in its axial direction. FIG. 2B is a schematic sectional view of the pressing roller in the direction crossing at right angles to its axis. As shown in FIGS. 2A and 2B, a pressing roller 40 has a mandrel 41 and an elastic layer 42 thereon. The elastic layer may have not only a single-layer structure but also one a multi-layer structure.

In the step (1) according to the present invention, as factors that should be controlled in order to crack the agglutinated stain of a developer origin on the elastic roller surface, the following are cited:

(i) the hardness of the elastic roller, (ii) the hardness of the pressing roller, (iii) the surface roughness Ra of the pressing roller, (iv) the force at which the pressing roller is pressed against the elastic roller and also (v) the relationship between the diameter of the elastic roller and the diameter of the pressing roller. Here, as to the factor (v), it follows that the shape of a nip between the elastic roller and the pressing roller is defined, and hence the factor (v) is considered to be concerned with occurrence of cracks.

Then, the factors (i) to (iv) are appropriately controlled within the numerical ranges as described above, and the factor (v) is set to satisfy Db<Da (Da: diameter of elastic roller; Db: diameter of pressing roller) as detailed later, and thereby, the agglutinated stain can be cracked.

Step (2)

The step (2) in the regenerated elastic roller manufacturing process of the present invention is a step in which an adhesive roller having an adhesive layer on its surface is brought into contact with the elastic roller to adhere the agglutinated stain of a developer origin that has been cracked in the step (1) to the surface of the adhesive roller, to thereby remove the agglutinated stain of toner from the surface of the elastic roller.

The adhesive roller used in the step (2) is a roller having an adhesive property of adhering the agglutinated stain of a developer origin on the elastic roller surface. The adhesive roller preferably has elasticity in order to improve the effect of removing the agglutinated stain of a developer origin. The adhesive roller preferably has an adhesive layer with elasticity on the periphery of the mandrel.

It is preferable for the mandrel of the adhesive roller to have strength high enough to be durable to the stress under which the adhesive roller is repeatedly brought into contact with the elastic roller. The material of the mandrel includes metals and plastics. Specifically, the material includes the same materials as exemplified for the elastic roller.

In the adhesive layer of the adhesive roller, a polymeric material such as rubbers or elastomer having elasticity may be used as a base material to reduce hardness, to thereby generate an adhesive property together with the elasticity. Preferably, that layer is further incorporated with an adhesion-providing resin which provides the layer with an adhesive property. The adhesive property of the adhesive roller may be controlled by changing the content of such an adhesion-providing resin.

Examples of the polymeric material of the base material include natural rubber, isoprene rubber, styrene rubber, butyl rubber, butadiene rubber, ethylene-propylene rubber, fluororubber, urethane rubber, silicone rubber, and combinations of two or more selected from these. Of these, non-polar rubbers such as natural rubber, isoprene rubber, styrene rubber, butyl rubber, butadiene rubber, ethylene-propylene rubber and silicone rubber are preferred because they have durability for the elasticity and the adhesive property. In particular, non-polar rubbers, such as isoprene rubber and butyl rubber, containing an isoprene structure are preferred. This is because they have durability to organic solvents in addition to the elasticity and the adhesive property. Hence, the toner adhered to the surface of the adhesive roller can easily be removed by the use of an organic solvent and the roller can repeatedly be used.

Examples of the adhesion-providing resin include the following:

Terpene type adhesion-providing resins such as terpene phenol resin, aromatic modified terpene resin, hydrogenated terpene resin and liquid terpene resin; pinene type resins such as α-pinene resin and β-pinene resin; rosin and rosin derivatives; petroleum resins; and mixtures of two or more selected from the above.

The adhesive layer of the adhesive roller preferably includes the non-polar rubber containing an isoprene structure and the terpene type adhesion-providing resin. As having such an adhesive layer, the adhesive roller can maintain its elasticity and adhesion over a longer period time, and the adhesive force can easily be regenerated, and thus, the number of the regenerated elastic rollers to be produced can be increased.

The adhesive layer of the adhesive roller is in a thickness of from 1 mm or more and 50 mm or less.

Such an adhesive roller is commercially designated as CLEAN DASH ROLLER (trade name; manufactured by Techno Roll Co., Ltd.).

The adhesive roller may have an elastic layer and the adhesive layer formed thereon.

The adhesive roller preferably has the adhesive force within the range of 0.2 N/cm or more and 20 N/cm or less. As long as the adhesive roller has an adhesive force of 0.2 N/cm or more, it can adhere the agglutinated stain of toner cracked on the elastic roller surface to effectively remove the agglutinated stain from the elastic roller. As long as the adhesive roller has an adhesive force of 20 N/cm or less, it does not damage the elastic roller surface when peeling off the agglutinated stain, and besides, when peelings or breakages occur in the adhesive roller itself, they can be inhibited from adhering to the elastic roller surface. The adhesive force of the adhesive roller may be controlled by appropriately selecting the types of base materials and adhesion-providing resins used in the adhesive layer and varying the content of the adhesion-providing resin.

Herein, the adhesive force of the adhesive roller can be defined by the value measured according to JIS Z 0237. A sheet made from the material of the resin layer of the elastic roller is used in place of a SUS304 steel sheet prescribed in JIS Z 0237, and is laminated to the adhesive roller. This is left standing for 1 hour at a temperature of 23° C. and a humidity of 50% RH. Thereafter, using a Tensilon type tensile tester, the sheet is torn off in the direction of 180° at a tensile rate of 300 mm/minute, where the maximum tensile force (N/cm) is defined as the adhesive force.

The sheet used as the resin layer of the elastic roller, used in measuring the adhesive force, may be made from a material described below.

First, the following materials are each mixed with methyl ethyl ketone (MEK).

Polytetramethylene glycol (trade name: PTG100SN; molecular weight Mn: 1,000, f: 2, where f represents the number of functional groups; available from Hodogaya Chemical Co., Ltd.): 100 parts by mass.

Isocyanate (trade name: MILLIONATE MT; MDI, f: 2; available from Nippon Polyurethane Industry Co., Ltd.): 21.2 parts by mass.

Then, the mixture obtained is allowed to react at a temperature of 80° C. for 6 hours in an atmosphere of nitrogen to produce a bifunctional polyurethane polyol prepolymer having a molecular weight Mw of 48,000, a hydroxyl value of 5.6, and a degree of molecular weight dispersion Mw/Mn of 2.9 and Mz/Mw of 2.5.

Next, 100 parts by mass of the polyurethane polyol prepolymer and 7.2 parts by mass of an isocyanate (trade name: TAKENATE B830; TMP modified TDI, f (the number of functional groups): equivalent to 3; available from Mitsui Takeda Chemicals, Inc.) are mixed to prepare a raw-material solution of 1.2 in NCO equivalent weight. A wet coating of this raw-material solution is heat-cured to produce the sheet.

It is preferable that the adhesive roller has hardness smaller than that of the elastic roller. This is because the contact area with the elastic roller can be made larger and also the agglutinated stain of toner can be easily adhered to the adhesive roller. For example, the adhesive roller may have the Asker-C hardness of 10 degrees or more and 50 degrees or less.

Further, the adhesive roller preferably has a diameter larger than that of the elastic roller. This is because the contact area with the elastic roller can be made larger and the agglutinated stain of toner can be easily adhered to the adhesive roller. For example, the adhesive roller may have a diameter of 10 mm or more and 100 mm or less.

With use of the adhesive roller, the agglutinated stain of toner adhered to the adhesive roller surface increases in quantity. Accordingly, it is preferable that adhesive roller is appropriately cleaned so that the agglutinated stain of toner can removed from the surface so as to restore the adhesive force. To restore the adhesive force of the adhesive roller, the adhesive roller may be wiped by using an organic solvent that does not impair the adhesive force, to thereby remove the agglutinated stain of toner. The organic solvent that may be used include methanol, ethanol, isopropyl alcohol, acetone, and methyl ethyl ketone. Such removal treatment can be carried out in such a state that the adhesive roller is detached.

Alternatively, an adhesive tape or another adhesive roller having stronger adhesive force is brought into contact with the adhesive roller to remove the agglutinated stain of toner from the adhesive roller. Moreover, a sheet member impregnated with an organic solvent may be pressed against the surface of the adhesive roller while being rotated, to thereby remove the agglutinated stain of toner without taking any downtime.

Figure 3A:
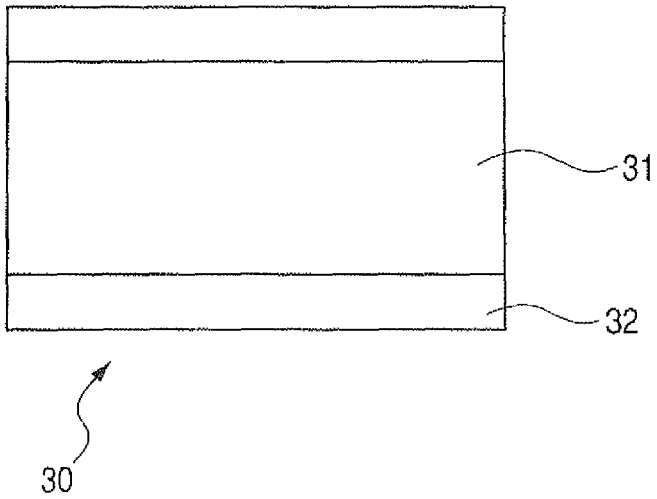
FIG. 3A is a schematic sectional view of an example of an adhesive roller in its axial direction, used in the regenerated elastic roller manufacturing process of the present invention.
Figure 3B:
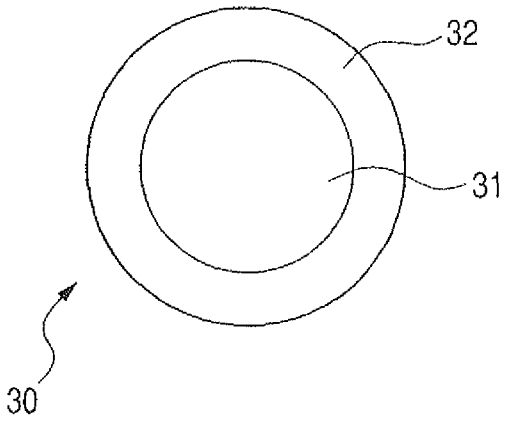
FIG. 3B is a schematic sectional view of an example of the adhesive roller in the direction crossing at right angles to its axis, used in the regenerated elastic roller manufacturing process of the present invention.

An example of such an adhesive roller specifically includes what is shown in FIGS. 3A and 3B. FIG. 3A is a schematic sectional view of the adhesive roller in its axial direction. FIG. 3B is a schematic sectional view of the adhesive roller in the direction crossing at right angles to its axis. As shown in FIGS. 3A and 3B, an adhesive roller 30 has a mandrel 31 and an adhesive layer 32 formed thereon. The adhesive layer 32 may have not only a single-layer structure but also a multilayer structure.

Steps (1) and (2)

Such steps (1) and (2) may be successively carried out, but may preferably simultaneously be carried out on the upstream side and the downstream side with respect to the elastic roller while being rotated. This is because the agglutinated stain on the elastic roller can efficiently be cracked in a shorter time and be removed therefrom.

Prior to the step (1), it is preferable to further provide a step in which the agglutinated stain of a developer origin on the elastic roller surface is kept at a temperature of from −10° C. or more and 10° C. or less. This is because the agglutinated stain can be reduced in flexibility within a range in which its adhesion is not lowered, and can be easily cracked through the step (1). A measure for keeping the agglutinated stain at the above temperature includes a method in which a gas with a temperature kept within the above range is blown, or a working atmosphere is kept within the above temperature range, so that at least the outermost surface of the elastic roller can have the above temperature.

The elastic roller, the pressing roller and the adhesive roller may have Asker-C hardnesses Ha, Hb and Hc, respectively, which preferably satisfy a relationship of Hc<Ha<Hb. This is because the agglutinated stain can more efficiently be removed.

That is, the rollers having the above relationship are considered to be advantageous on the following points.

The point that the level of deformation of the elastic roller in virtue of the pressing roller can be enlarged to efficiently crack the agglutinated stain.

The point that the contact area between the adhesive roller and the elastic roller can be enlarged to easily remove the agglutinated stain from the elastic roller.

The elastic roller, the pressing roller and the adhesive roller may also have diameters Da, Db and Dc, respectively, which preferably satisfy a relationship of Db<Da<Dc. This is because the agglutinated stain can more efficiently be removed. The rollers having such a relationship are advantageous in the following points.

The point that the pressure at which the pressing roller is pressed against the elastic roller to apply a load can be enlarged to efficiently crack the agglutinated stain.

The point that the contact area between the adhesive roller and the elastic roller can be enlarged to easily remove the agglutinated stain from the elastic roller.

Figure 4:
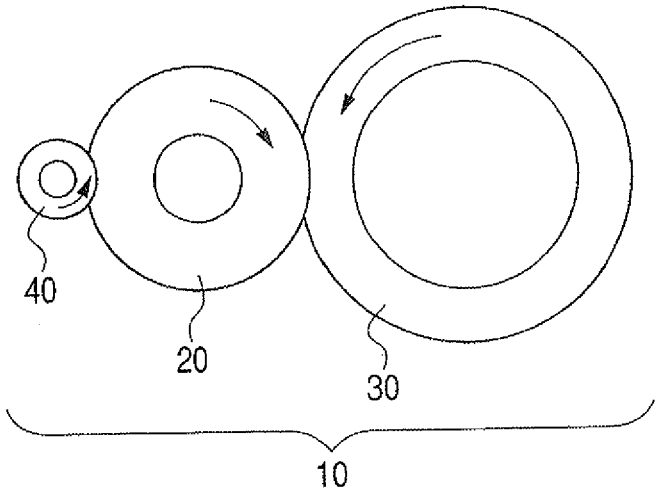
FIG. 4 is a schematic structural view showing an example of a regenerated elastic roller manufacturing unit to which the regenerated elastic roller manufacturing process of the present invention is applied.

FIG. 4 is a schematic structural view showing an example of a regenerated elastic roller manufacturing unit used in the regenerated elastic roller manufacturing process of the present invention. In a regenerated elastic roller manufacturing unit 10 shown in FIG. 4, an elastic roller 20 to be recovered is placed in a rotatable state. A pressing roller 40 is placed in a freely rotatable state while pressing the elastic roller 20 at a certain pressure. The pressing roller 40 deforms the agglutinated stain of a developer origin on the surface of the elastic roller at a nip with the elastic roller 20 to crack the agglutinated stain. An adhesive roller 30 is also placed in a freely rotatable state while coming into contact with the elastic roller 20. The agglutinated stain of a developer origin cracked at the nip between the elastic roller 20 and the pressing roller 40 adheres to the surface of the adhesive roller 30 and is removed from the surface of the elastic roller 20. The respective rollers are supported by supports (not shown). The respective supports are set up so that the distances between them are controllable. This makes nip pressure controllable between the respective rollers. The pressing roller 40 and the adhesive roller 30 may be rotated following the elastic roller 20 rotated by a motor (not shown), or their mandrels may be connected with rotating shafts of motors so that the rotational speed can be controlled for each roller to make their rotational directions selectable.

It is described below how such a regenerated elastic roller manufacturing unit operates.

First, the elastic roller 20 to be recovered is placed at a predetermined position. The pressing roller 40 is also so placed as to apply a pressure of 500 N/m in drawing pressure to the elastic roller 20.

Next, the rotational speed of the elastic roller is set at, e.g., 5 to 300 rpm taking into account the removal efficiency of the agglutinated stain of toner. Here, the rotational speeds of the adhesive roller 30 and the pressing roller 40 may be so set as to produce a difference in peripheral speed with respect to the elastic roller 20. Making these rollers have different rotational speeds enables the agglutinated stain to be efficiently broken and removed by utilizing the effect of rubbing.

The elastic roller 20, the adhesive roller 30 and the pressing roller 40 are rotated to carry out processing for a time sufficient for the removal of the agglutinated stain, e.g., for 5 to 120 seconds. The agglutinated stain cracked is adhered to the adhesive roller surface, and thus removed from the surface of the elastic roller 20. Thereafter, the rotational drive is stopped, and the elastic roller having been recovered is taken out.

Figure 5:
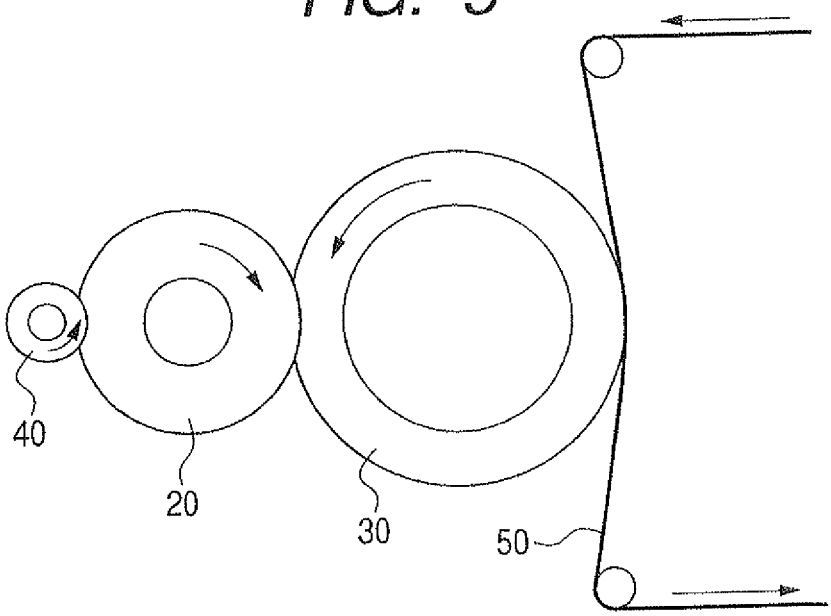
FIG. 5 is a schematic structural view showing another example of a regenerated elastic roller manufacturing unit to which the regenerated elastic roller manufacturing process of the present invention is applied.

FIG. 5 is a schematic structural view showing another example of the regenerated elastic roller manufacturing unit according to the present invention. The regenerated elastic roller manufacturing unit shown in FIG. 5 is set up by providing the regenerated elastic roller manufacturing unit shown in FIG. 4 with a cleaning member 50 for the adhesive roller 30. The cleaning member 50 is a sheet member impregnated with an organic solvent. The sheet member 50 is brought into pressure touch with the adhesive roller 30, and in this state, is so driven as to supply its fresh surface as the adhesive roller is rotated. The agglutinated stain of a developer origin adhered to the surface of the adhesive roller 30 from the elastic roller 20 being rotated further moves to the sheet member 50, where the surface of the adhesive roller 30 is cleaned. Hence, the agglutinated stain can be removed from the elastic roller 20 repeatedly over a long period of time.

Figure 6:
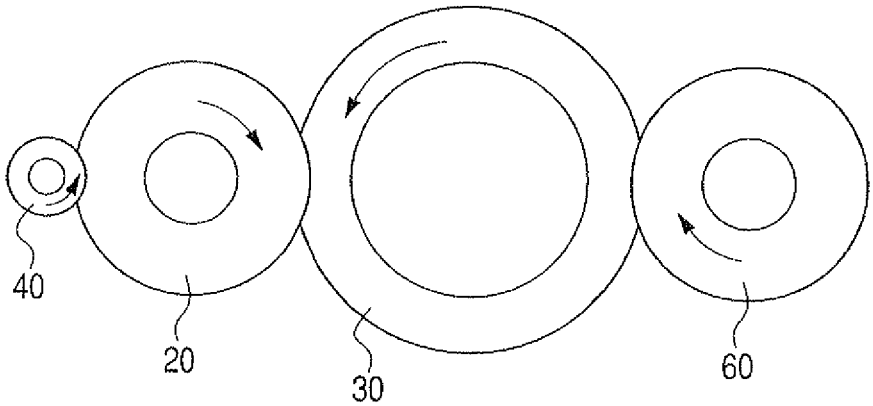
FIG. 6 is a schematic structural view showing still another example of a regenerated elastic roller manufacturing unit to which the regenerated elastic roller manufacturing process of the present invention is applied.

FIG. 6 is a schematic structural view showing still another example of the regenerated elastic roller manufacturing unit according to the present invention. The regenerated elastic roller manufacturing unit shown in FIG. 6 is provided with a cleaning roller 60 having a strong adhesive force as a cleaning member for the adhesive roller. The cleaning roller 60 is set up in such a state that it is in pressure touch with the adhesive roller 30. Then, the cleaning roller is driven so that the agglutinated stain adhered to the surface of the adhesive roller 30 may be transferred to the cleaning roller 60 as the adhesive roller 30 is rotated. The agglutinated stain adhered to the surface of the adhesive roller 30 from the elastic roller 20 being rotated further moves to the surface of the cleaning roller 60, thus the surface of the adhesive roller 30 is cleaned. As a result, the agglutinated stain can be removed from the elastic roller 20 repeatedly over a long period of time.

The regenerated elastic roller obtained by the above regenerated elastic roller manufacturing process can be reused as the developing roller, charging roller, transfer roller, fixing roller or cleaning roller for use in image forming apparatuses utilizing an electrophotographic process. In particular, it is suitable for use in the developing roller.

The electrophotographic image forming apparatus according to the present invention has a charging member which charges a photosensitive member and a developing member which develops an electrostatic latent image held on the photosensitive member, and is provided with the above regenerated elastic roller.

Figure 7:
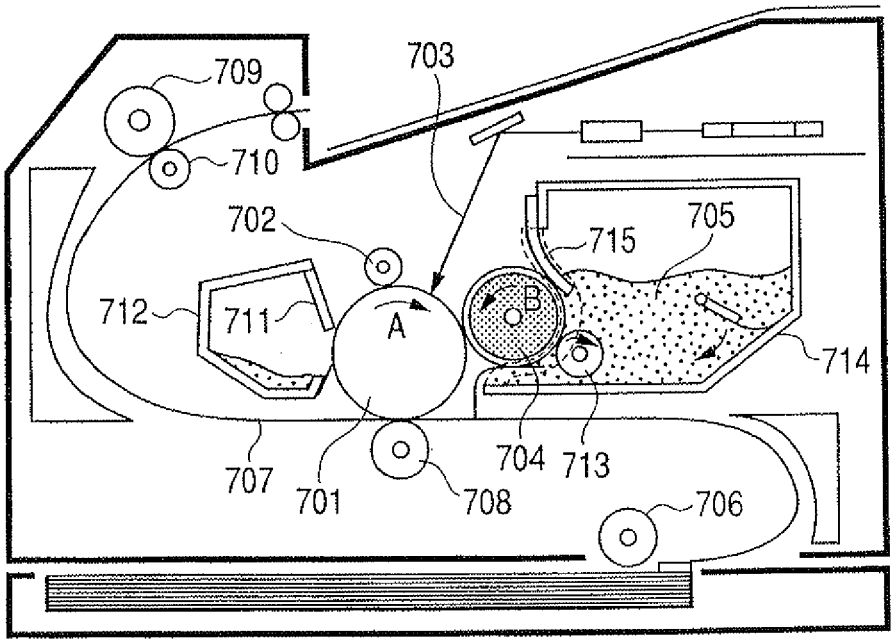
FIG. 7 is a schematic structural view showing an example of an electrophotographic image forming apparatus of the present invention.

FIG. 7 is a schematic sectional view showing an example of such an electrophotographic image forming apparatus. The electrophotographic image forming apparatus shown in FIG. 7 is provided with a photosensitive drum 701, a charging roller 702, and laser light 703 as an exposure means by which electrostatic latent images are written on the photosensitive drum 701.

The apparatus is provided with a developing assembly R which develops into toner images the electrostatic latent images held on the photosensitive drum surface, and a transfer roller 708 which transfers the toner images to a recording medium 707 such as paper fed by means of a paper feed roller 706. A fixing roller 709 is further provided which fixes the toner images transferred to the recording medium by the aid of pressure applied by a pressure roller 710. After image formation has been completed, the recording medium to which the toner images have been fixed is so set as to be delivered out of the apparatus.

The apparatus is provided with a cleaning blade 711 with which the developer remaining on the photosensitive drum 701 without being transferred is removed as the photosensitive drum is rotated, to clean its surface, a waste toner container 712 in which the toner scraped off from the photosensitive drum surface is collected, and so forth. The photosensitive drum from which such residual toner has been removed is so set as to stand by for next image formation. A cleaning roller may be used in place of the cleaning blade 711.

The developing assembly R is provided with a developer container 714 which holds a developer 705 therein, a developing roller 704, a developer feed roller 713, a developer control blade 715, an agitating blade and so forth. The developing roller is so placed as to close an opening of the developer container and face the photosensitive drum at its part uncovered from the developer container. To this developing roller, the regenerated elastic roller described above is applied.

Four electrophotographic process cartridges containing black, magenta, cyan and yellow developers, respectively, may be arranged and their respective toner images formed may be transferred and fixed to a recording medium, to thereby produce a color image-formed matter.

The regenerated elastic roller described above may also be applied to the above charging roller, fixing roller, pressure roller, developer feed roller, cleaning roller, paper feed roller, transfer roller and so froth.

In such an image forming apparatus, the photosensitive drum 701 rotated in the direction of an arrow A is charge-processed on its surface by the charging roller 702 so as to be provided with uniform potential with a predetermined polarity. Thereafter, the photosensitive drum 701 thus charged is exposed to exposure light 703 according to objective image information, where electrostatic latent images corresponding to objective images are formed on the surface of the photosensitive drum 701. The electrostatic latent images are rendered visible as toner images by means of the developer 705 fed by the developing roller 704 rotated in the direction of an arrow B. The toner images formed by rendering the latent images visible are transferred to the recording medium 707 by the aid of voltage applied by the transfer roller 708 from the back side of the recording medium 707 fed by the paper feed roller 706, and this recording medium 707 with the toner images is transported to the part between the fixing roller 709 and the pressure roller 710, where the toner images are fixed to produce an image-formed matter. The photosensitive drum 701 is cleaned with the cleaning blade 711 in order to remove the toner and dust which remain thereon, then de-charged by means of a charge-eliminating member (not shown) and again proceeds with the charging step. The toner removed by the cleaning blade 711 is collected in a waste toner container 712.

In the developer container, the developer sent to the developer feed roller by the aid of the agitating blade is uniformly applied on the developing roller surface by means of the developer control blade. Subsequently, it is transported to the photosensitive drum as the developing roller is rotated. Then, it is transferred onto electrostatic latent images to develop the electrostatic latent images.

The developer remaining on the developing roller without being used for the development of electrostatic latent images is transported into the developer container as the developing roller is rotated, and is scraped off by the developer feed roller in the developer container, where, at the same time, the developer is anew fed to the developing roller.

The electrophotographic process cartridge of the present invention has a photosensitive member on which an electrostatic latent image is to be formed, a charging member which charges the photosensitive member and a developing member which develops the electrostatic latent image held on the photosensitive member, and is so set up as to be detachably mountable to the main body of an electrophotographic image forming apparatus. It further has the regenerated elastic roller according to the present invention as at least one of the charging member and the developing member.

It is only required for the electrophotographic process cartridge to have the photosensitive member, the charging member and the developing member and to be detachably mountable to the main body of an electrophotographic image forming apparatus. As an example of the electrophotographic process cartridge, the following may be cited: a process cartridge which has, in the image forming apparatus shown in FIG. 7, the charging roller 702, the photosensitive drum 701 and the developing roller 704 in an integral form and is detachably mountable to the main body of an electrophotographic image forming apparatus. The process cartridge may further have the developer feed roller 713, the developer control blade 715 and the agitating blade, and also at least one of the developer container holding the developer therein, the transfer roller, the cleaning roller and so froth, which are supported in an integral form.

EXAMPLES

The regenerated elastic roller, electrophotographic process cartridge and electrophotographic image forming apparatus of the present invention are specifically described below in detail. The technical scope of the present invention is by no means limited by these. In the following, "part(s)" refers to "parts by mass" unless particularly noted.

Example 1

Production of Elastic Roller (A-1)

As a mandrel, a mandrel made of SUS stainless steel was used to the outer periphery of which an adhesive was applied, and was then baked.

As a material for an elastic layer, a liquid silicone rubber was prepared in the following way.

First, the following materials were mixed to prepare a base material for the liquid silicone rubber.

- Dimethyl polysiloxane having a viscosity of 100 Pa·s, which have been substituted with vinyl groups at both ends: 100 parts by mass.
- Quartz powder (Min-USil, available from Pennsylvania Glass Sand Corporation) as filler: 7 parts by mass.
- Carbon black (DENKA BLACK, a powdery product, available from Denki Kagaku Kogyo Kabushiki Kaisha): 8 parts by mass.

The base material obtained was divided into two portions. A platinum compound was mixed in one of them as a curing catalyst in trace quantity, and 3 parts by mass of an organohydrogenpolysiloxane was mixed in the other. These mixtures were mixed in a mass ratio of 1:1 to prepare the liquid silicone rubber.

The mandrel was placed at the center of a cylindrical mold, where the liquid silicone rubber was poured into the cylindrical mold through its fill opening, and was heat-cured at a temperature of 120° C. for 5 minutes. The molded product was cooled and thereafter demolded. This was further heated at a temperature of 200° C. for 4 hours to complete curing reaction. Thus, an elastic layer of about 4 mm in thickness was provided on the outer periphery of the mandrel.

Next, the following materials were stepwise introduced in methyl ethyl ketone.

Polytetramethylene glycol (trade name: PTG1000SN; molecular weight Mn: 1,000, f: 2, where f represents the number of functional groups; available from Hodogaya Chemical Co., Ltd.): 100 parts by mass.

Isocyanate (trade name: MILLIONATE MT; MDI, f: 2; available from Nippon Polyurethane Industry Co., Ltd.): 21.2 parts by mass.

The mixture obtained was allowed to react at a temperature of 80° C. for 6 hours in an atmosphere of nitrogen to produce a bifunctional polyurethane polyol prepolymer having a molecular weight Mw of 48,000, a hydroxyl value of 5.6, and a degree of molecular weight dispersion Mw/Mn of 2.9 and Mz/Mw of 2.5.

100 parts by mass of this polyurethane polyol prepolymer and 7.2 parts by mass of an isocyanate (trade name: TAKENATE B830; TMP modified TDI, f (the number of functional groups): equivalent to 3; available from Mitsui Takeda Chemicals, Inc.) were mixed so as to be 1.2 in NCO equivalent weight. Further, 20 parts by mass of carbon black (#1000; pH: 3.0; available from Mitsubishi Chemical Corporation) was added to prepare a liquid raw-material mixture.

To the liquid raw-material mixture, methyl ethyl ketone was added to adjust its solid content to 25% by mass. Further, 30 parts by mass of urethane resin particles (trade name: C400 Transparent; particle diameter: 14 μm; available from Negami Chemical Industrial Co., Ltd.) were added, followed by uniform dispersion and mixing to prepare a coating fluid for surface layer formation.

Using this coating fluid, a surface layer was formed by a dipping method on the elastic layer formed on the outer periphery of the mandrel. Specifically, the coating fluid, which was kept at a liquid temperature of 23° C., was poured into a cylinder of 32 mm in inner diameter and 300 mm in length from its bottom in an amount of 250 cc per minute, and the coating fluid having overflowed from the upper end of the cylinder was again poured into the cylinder from its bottom so as to be circulated. The elastic layer formed on the outer periphery of the mandrel was dipped into the coating fluid in the cylinder at a dipping rate of 100 mm/s, was then stopped for 10 seconds, and thereafter drawn up under conditions of an initial rate of 300 mm/s and a final rate of 200 mm/s. The wet coating formed was naturally dried for 60 minutes.

Then, the coating dried was heat-treated at 140° C. for 60 minutes to effect curing to form a surface layer of 15 μm in thickness and 1.0 μm in surface roughness Ra on the outer periphery of the elastic layer. The elastic roller (A-1) thus obtained was 16 mm in outer diameter and 45 degrees in Asker-C hardness.

Formation of agglutinated stain of developer origin:

The elastic roller (A-1) was employed as a developing roller in an electrophotographic process cartridge for an electrophotographic image forming apparatus (trade name: Color Laser Jet 4700dn, manufactured by HP Ltd.). This was left standing for 24 hours in an environment of a temperature of 15° C. and a humidity of 10% RH. Thereafter, this electrophotographic process cartridge was mounted to the main body of the electrophotographic image forming apparatus, and in the environment of a temperature of 15° C. and a humidity of 10% RH, images of 1% in print percentage were reproduced until the remaining amount of the developer came to be 20 g, to thereby adhere the agglutinated stain of a developer origin to the developing roller surface.

Next, the developing roller was detached from the electrophotographic process cartridge, and then air was blown against the surface of the developing roller to blow off developer components on the developing roller surface. Thereafter, the developing roller surface was observed with a scanning electron microscope at 5,000 magnifications to find that components of a developer origin were adhered much to the roller surface. The surface of the agglutinated stain was seen not to crack.

Production of Adhesive Roller (C-1)

A mandrel was readied which was a mandrel made of SUS stainless steel to the outer periphery of which an adhesive was applied.

A mixture of the following materials was extruded into a tube by means of an extruder, followed by vulcanization at 140° C. for 30 minutes in a vulcanizer to produce a tubular extruded product.

Butyl rubber: 100 parts by mass.

Quartz powder (Min-USil, available from Pennsylvania Glass Sand Corporation) as filler: 5 parts by mass.

Terpene phenol resin (YS POLYSTAR U, available from Yasuhara Chemical Co., Ltd.): 20 parts by mass.

To this tubular extruded product, the mandrel readied previously was press-fitted and bonded. Further, the surface of the resulting product was ground by means of a cylindrical grinder to obtain an adhesive roller of 50 mm in diameter and 30 degrees in Asker-C hardness. The adhesive force of this adhesive roller was 5 N/cm. The adhesive roller was used after being appropriately cleaned with an organic solvent so as to restore the adhesive force.

Production of Pressing Roller (B-1)

A mandrel was readied which was a mandrel made of SUS stainless steel to the outer periphery of which an adhesive was applied.

A mixture of the following materials was extruded into a tube by means of an extruder, followed by vulcanization at 140° C. for 30 minutes in a vulcanizer to obtain a tubular extruded product having the desired outer diameter.

Butyl rubber (Butyl 1065,available from Japan Butyl Co., Ltd.): 100 parts by mass.

Quartz powder (Min-USil, available from Pennsylvania Glass Sand Corporation) as filler: 15 parts by mass.

To this tubular extruded product, the mandrel readied previously was press-fitted and bonded. Further, The surface of the resulting product was ground by means of a cylindrical grinder to produce a pressing roller of 0.1 μm in surface roughness Ra, 8 mm in diameter and 60 degrees in Asker-C hardness.

The elastic roller (A-1) on which a layer composed of the agglutinated stain of a developer origin was formed, the pressing roller (B-1) and the adhesive roller (C-1) were set in the regenerated elastic roller manufacturing unit shown in FIG. 4. In the step (1), the pressure at which the pressing roller was pressed against the elastic roller was set at 500 N/m in drawing pressure. In an atmosphere of normal temperature, the elastic roller was rotated at 60 rpm, and the pressing roller and the adhesive roller were rotated for 30 second following the elastic roller to produce a regenerated elastic roller.

The elastic roller surface having passed through the step (1) was observed with a scanning electron microscope (trade name: FE-SEM4700, manufactured by Hitachi Ltd.) at 5,000 magnifications. As a result, the agglutinated stain on the elastic roller surface was found to have cracks which were not seen before passing through the step (1). The surface of the regenerated elastic roller produced through the steps (1) and (2) was also observed with the scanning electron microscope at 5,000 magnifications to find that any agglutinated stain was not seen to be present. This regenerated elastic roller was used in image formation in the following way, and was evaluated for the quality as a regenerated elastic roller.

Image Formation & Image Evaluation

—Evaluation—

Evaluation on Ghosts:

The regenerated elastic roller of this Example was set as a developing roller in an electrophotographic process cartridge for an electrophotographic image forming apparatus (trade name: Color Laser Jet 4700dn; manufactured by HP Ltd.). This electrophotographic process cartridge was left standing for 24 hours in an environment of a temperature of 15° C. and a humidity of 10% RH. Thereafter, the electrophotographic process cartridge was mounted to the main body of the electrophotographic image forming apparatus. In the environment of a temperature of 15° C. and a humidity of 10% RH, images in which solid black images of 15 mm×15 mm were printed at intervals of 15 mm in a horizontal line in the upper region of the images, and further, a halftone image was printed in the lower region of the images were reproduced as images for evaluation on ghosts.

If images are formed by using a developing roller on the surface of which the agglutinated stain of toner has been much formed, the charge quantity of toner on the developing roller becomes short. If images are formed in this state, the toner is insufficiently scraped off by the toner feed roller, and development residual toner remains on the developing roller without being replaced. As a result, due to the difference in development efficiency between areas solid-developed and areas not done, patch patters appear in the halftone region in developing roller cycles. This is called ghosts. The level of ghosts can be used as an index of how far the contamination of surface has been eliminated as a result of the regeneration processing.

On ghosts appearing in the halftone region of the images reproduced, evaluation was made according to the following criteria.

A: No ghosts are visually seen at all.

B: Ghosts are slightly seen.

C: Ghosts are seen in which even corners are viewable.

D: Ghosts further come about over many cycles in developing roller rotation.

Evaluation on Fogging:

After the evaluation on ghosts, white solid images were further reproduced, and the extent of fogging (fogging value) was measured in the following way.

Reflection density of a transfer sheet before image formation and reflection density of the transfer sheet after image formation of solid white images were measured with a reflection densitometer (trade name: TC-6DS/A, manufactured by Tokyo Denshoku Technical Center Company Ltd.), and the difference between them was defined as the fogging value of the developing roller.

The whole of the image-printed regions of the transfer sheet were scanned to measure the reflection density, and the minimum value thereof was regarded as the reflection density of the transfer sheet.

When white solid images are formed by using a developing roller on the surface of which the agglutinated stain is much formed, toner short in charge quantity moves onto the photosensitive member. Further, this toner is transferred onto the transfer sheet to bring about fogging. Accordingly, the fogging value may be used as an index of how far the agglutinated stain on the surface of the regenerated elastic roller has been removed.

On the fogging value, evaluation was made according to the following criteria. It is considered that the smaller the fogging value is, the more the agglutinated stain on the roller surface has been removed. Here, the following evaluation A and evaluation B indicate levels at which "fogging" is not visually detected. On the other hand, evaluation C and evaluation D indicate levels at which "fogging" is visually clearly detected.

A: The value is smaller than 1.0.

B: The value is 1.0 or more and smaller than 2.0.

C: The value is 3.0 or more and smaller than 5.0.

D: The value is 5.0 or more.

Comparative Example 1

The elastic roller (A-1) with the agglutinated stain formed thereon was used as it was, without being subjected to regeneration processing, for the same experiments on image formation and image evaluation as in Example 1. Ghosts and fogging of the images obtained were evaluated according to the above criteria. The results obtained are shown in Table 1.

Comparative Example 2

The elastic roller (A-1) with the agglutinated stain formed thereon was subjected to regeneration processing in the same way as in Example 1 except that the pressing roller (B-1) was not placed. The surface of the regenerated elastic roller obtained was observed with a scanning electron microscope (trade name: FE-SEM4700, manufactured by Hitachi Ltd.) at 5,000 magnifications. As a result, any agglutinated stain was unable to be seen. Next, this regenerated elastic roller was used for the same experiments on image formation and image evaluation as in Example 1. The images obtained were evaluated according to the same criteria as in Example 1. The results obtained are shown in Table 1.

TABLE 1

| | Step(s) of regeneration processing carried out | Ghosts | Fogging |
|---|---|---|---|
| Example 1 | First & second steps | A | A |
| Comparative Example 1 | Not carried out | C | D |
| Comparative Example 2 | Second step only | B | C |

From the results shown in Table 1 above, it is seen that the regenerated elastic roller obtained through the steps (1) and (2) has had the agglutinated stain removed from its surface, can improve image quality at a level high enough for the roller to be reusable and can be used as a developing roller. From the results of Comparative Example 2, it is ascertainable that the agglutinated stain on the elastic roller surface can be removed in appearance even by the use of only the adhesive roller, but the roller is clearly difference in quality from the regenerated elastic roller in Example 1 when being used in the electrophotographic image forming apparatus.

Example 2

Elastic Roller

Two types of elastic rollers (A-2-1 and A-2-2) were produced in the same way as in Example 1 except that the quartz powder to be contained as filler in the elastic layer was mixed in amounts of 2 parts by mass and 20 parts by mass, respectively. The elastic rollers were degrees and 70 degrees in Asker-C hardness, respectively.

Pressing Roller:

Three types of pressing rollers (B-2-1, B-2-2 and B-2-3) were produced in the same way as in Example 1 except that the quartz powder was mixed in amounts of 8 parts by mass, 10 parts by mass and 25 parts by mass, respectively. The pressing rollers were 45 degrees, 50 degrees and 80 degrees in Asker-C hardness, respectively.

Adhesive Roller:

Four types of adhesive rollers (C-2-1, C-2-2, C-2-3 and C-2-4) were produced in the same way as in Example 1 except that the quartz powder was mixed in amounts of 0 parts by mass, 4 parts by mass, 6 parts by mass and 8 parts by mass, respectively. The adhesive rollers were 20 degrees, 40 degrees, 45 degrees and 50 degrees in Asker-C hardness, respectively.

Regenerated elastic rollers were produced in the same way as in Example 1 except that the elastic roller, the pressing roller and the adhesive roller were used in combination as shown in Table 2 below. Then, the regenerated elastic rollers obtained were evaluated in the same way as in Example 1. The results are shown together in Table 2.

TABLE 2

| Example: | Elastic roller | Pressing roller | Adhesive roller | Aggluti-nated stain with or without cracks | Ghosts | Fog-ging |
|---|---|---|---|---|---|---|
| 2-1 | A-1 | B-2-1 | C-2-3 | with | B | B |
| 2-2 | A-1 | B-2-1 | C-1 | with | A | B |
| 2-3 | A-1 | B-1 | C-2-3 | with | B | B |
| 2-4 | A-1 | B-1 | C-1 | with | A | A |
| 2-5 | A-1 | B-2-2 | C-2-2 | with | A | A |
| 2-6 | A-2-1 | B-2-2 | C-2-1 | with | A | A |
| 2-7 | A-2-2 | B-2-3 | C-2-4 | with | A | A |

It is seen from the above results that in Examples 2-1 to 2-7, the regenerated elastic rollers have had the agglutinated stain of toner removed from their surfaces, can improve image quality at a level high enough for the rollers to be reusable and can be used as developing rollers. It is also seen that the image quality is especially good in Examples 2-4 to 2-7 in which the relationship of Hc<Ha<Hb is satisfied where Ha, Hb and Hc represent Asker-C hardnesses of the elastic roller, pressing roller and adhesive roller, respectively.

Example 3

The procedure described in Example 1 was repeated to produce the elastic roller A-1, the pressing roller B-1 and the adhesive roller C-1.

An elastic roller A-3-1 was also produced in the same way as in the elastic roller A-1 in Example 1 except that the thickness of the elastic layer was so changed as to be 12 mm.

Pressing rollers (B-3-1, B-3-2 and B-3-3) were produced in the same way as in the pressing roller in Example 1 except that they were 10 mm, 14 mm and 16 mm in diameter, respectively.

Adhesive rollers (C-3-1, C-3-2 and C-3-3) were produced in the same way as in Example 1 except that they were 14 mm, 16 mm and 18 mm in diameter, respectively.

Regenerated elastic rollers were produced in the same way as in Example 1 except that these rollers in were used in combination as shown in Table 3 below. Images were formed using the regenerated elastic rollers as developing rollers to make an evaluation. In this Example, evaluation was also made on how far the agglutinated stain of a developer origin on the elastic roller surface was cracked. To make the evaluation, the surfaces of elastic rollers having passed through only the step (1) were observed on a scanning electron microscope (trade name: FE-SEM4700, manufactured by Hitachi Ltd.) at 5,000 magnifications, where the extent of cracks seen on the agglutinated stain surface within the range of 50 μm×50 μm in area was evaluated according to the following criteria. It is considered that as the agglutinated stain is increasingly divided by cracks, the agglutinated stain is more easily removed by the adhesive roller.

A: The agglutinated stain is entirely cracked and finely divided.

B: The agglutinated stain is entirely cracked and partially finely divided.

The results of this Example are shown together in Table 3 below.

TABLE 3

| Example: | Elastic roller | Pressing roller | Adhesive roller | Extent of cracks | Ghosts | Fog-ging |
|---|---|---|---|---|---|---|
| 3-1 | A-1 | B-3-3 | C-3-2 | B | B | B |
| 3-2 | A-1 | B-3-3 | C-1 | B | A | B |
| 3-3 | A-1 | B-1 | C-3-2 | A | B | B |
| 3-4 | A-1 | B-1 | C-1 | A | A | A |
| 3-5 | A-1 | B-3-2 | C-3-3 | A | A | A |
| 3-6 | A-3-1 | B-3-1 | C-3-1 | A | A | A |
| 3-7 | A-3-1 | B-1 | C-1 | A | A | A |

As shown in Table 3, in Examples 3-1 to 3-7, the regenerated elastic rollers have had the agglutinated stain removed from their surfaces, can improve image quality at a level high enough for the rollers to be reusable and can be used as developing rollers. Further, the image quality can be more improved in Examples 3-4 to 3-7 in which the relationship of Db<Da<Dc is satisfied where Da, Db and Dc represent the diameters of the elastic roller, pressing roller and adhesive roller, respectively. The reason for the above is presumed to be due to the fact that the agglutinated stain is more finely divided in Examples 3-4 to 3-7 than in Examples 3-1 to 3-3.

Example 4

In the same way as in Example 1 except that the pressure at which the pressing roller was pressed against the elastic roller (drawing pressure) was changed as shown in Table 4, thirty regenerated elastic rollers were produced for each pressure. Visual observations were made for the thirty regenerated elastic rollers on whether or not their surfaces were scratched due to pressing with the pressing roller. All the regenerated elastic rollers were also evaluated in the same way as in Example 1. The results obtained are shown in Table 4.

TABLE 4

| Example: | Drawing pressure (N/m) | Agglutinated stain with or without cracks | Ghosts | Fogging | Surface with or without scratches |
|---|---|---|---|---|---|
| 4-1 | 50 | with | B | B | without |
| 4-2 | 100 | with | A | A | without |
| 4-3 | 500 | with | A | A | without |
| 4-4 | 3,000 | with | A | A | without |

As shown in Table 4, in Examples 4-1 to 4-5, the agglutinated stain on the roller surface can be removed to the extent that the regenerated elastic rollers are reusable as developing rollers. The regenerated elastic roller surfaces are also seen not to be scratched due to the step (1) in which the agglutinated stain is cracked.

Example 5

Adhesive rollers (C-5-1, C-5-2, C-5-3 and C-5-4) were produced in the same way as in Example 1 except that the terpene phenol resin as an adhesion-providing resin was used in amounts of 5 parts by mass, 10 parts by mass, 30 parts by mass and 50 parts by mass, respectively, based on 100 parts by mass of butyl rubber.

The adhesive roller C-1 was also produced in the same way as in Example 1.

The adhesive force of each of these adhesive rollers was measured, and using each adhesive roller, thirty regenerated elastic rollers were produced in the same way as in Example 1. Visual observations were made for the thirty regenerated elastic rollers on whether or not their surfaces were scratched. All the regenerated elastic rollers were also evaluated in the same way as in Example 1. The evaluation results and the adhesive force of each adhesive roller are shown in Table 5.

TABLE 5

| Example: | adhesive roller | adhesive force (N/m) | Agglutinated stain with or without cracks | Ghosts | Fogging | Surface with or without scratches |
|---|---|---|---|---|---|---|
| 5-1 | C-5-1 | 0.1 | with | B | B | without |
| 5-2 | C-5-2 | 0.2 | with | A | A | without |
| 5-3 | C-1 | 5 | with | A | A | without |
| 5-4 | C-5-3 | 20 | with | A | A | without |
| 5-5 | C-5-4 | 25 | with | B | B | without |

As shown in Table 5, in Examples 5-1 to 5-5, the agglutinated stain on the roller surface can be removed to the extent that the regenerated elastic rollers are reusable as developing rollers. The surfaces of the regenerated elastic rollers are also seen not to be scratched even when the adhesive rollers different in adhesive force are used.

Example 6

In the regenerated elastic roller manufacturing unit shown in FIG. 4, the adhesive roller 30 was set apart from the elastic roller 20, and only the pressing roller 40 was pressed against the elastic roller 20 under the same conditions as those in Example 1, where the elastic roller was rotated at 60 rpm for 15 seconds. Then, the pressing roller 40 was set apart from the elastic roller 20, and only the adhesive roller 30 was so brought into contact with the latter as to be under the same conditions as those in Example 1, where the elastic roller was rotated at 60 rpm for 15 seconds. The regenerated elastic roller thus obtained was evaluated in the same way as in Example 1. The results obtained are shown in Table 6.

TABLE 6

| | Agglutinated stain with or without cracks | Ghosts | Fogging |
|---|---|---|---|
| Example 6 | with | B | B |

From the results shown in Table 6, it is seen that the mode of Example 1 in which the pressing roller and the adhesive roller are brought into contact simultaneously with the elastic roller and the pressing against the agglutinated stain and the removal of the agglutinated stain cracked thereby are continuously carried out, is advantageous to the production of high-quality regenerated elastic rollers.

Example 7

Prior to the step (1), elastic rollers with the agglutinated stain adhered thereon were left standing for 1 hour in a thermostatic environment kept at temperature shown in Table 7. Regenerated elastic rollers were produced in the same way as in Example 1 except that these elastic rollers were moved from the thermostatic environment to an environment of normal temperature and an adhesive roller of 0.1 N/cm in adhesive force was immediately used. Evaluation was made in the same way. Results obtained are shown in Table 7.

TABLE 7

| Example: | Cooling temperature | Ghosts | Fogging |
|---|---|---|---|
| 7-1 | No cooling (25° C.) | B | B |
| 7-2 | 10° C. | A | A |
| 7-3 | 0° C. | A | A |
| 7-4 | −10° C. | A | A |
| 7-5 | −20° C. | B | B |

As shown in Table 7, it is seen that when previously cooling the agglutinated stain, regenerated elastic rollers with a higher grade can be produced.

Example 8

Ten regenerated elastic rollers were produced in the same way as in Example 1 except that an adhesive roller (trade name: NU Adhesive Silicone; manufactured by Techno Roll Co., Ltd.) whose rubber material was non-polar silicone rubber was used as an adhesive roller. Then, the regenerated elastic roller produced 10th was evaluated in the same way as in Example 1. As a result, ghosts and fogging were both evaluated as "A".

Example 9

A hundred regenerated elastic rollers were produced in the same way as in Example 1 except that an adhesive roller (trade name: NU Adhesive Silicone; manufactured by Techno Roll Co., Ltd.) whose rubber material was non-polar silicone rubber was used as an adhesive roller. Then, the regenerated elastic roller produced 100th was evaluated in the same way as in Example 1. As a result, ghosts and fogging were both evaluated as "B". Making a comparison between this fact and the evaluation result in Example 1, it is seen that the adhesive roller using the butyl rubber as the rubber material and the terpene type resin as the adhesion-providing resin can produce regenerated elastic rollers with a higher grade over a longer period of time.

Example 10

Elastic rollers (A-10-1, A-10-2 and A-10-3) were produced in the same way as in Example 1 except that in Example 1, the proportion of the polyurethane polyol prepolymer to the isocyanate was changed so that the NCO equivalent weight came to be the values shown in Table 8 below. The elastic roller (A-1) was also produced in the same way as in Example 1. The agglutinated stain was formed on the surface of each of these four types of elastic rollers by the method described in Example 1, and the processing of removing the agglutinated stain was repeatedly carried out five times. Visual observations were made for each of the regenerated elastic rollers obtained by the processing carried out five times, on whether or not their elastic layer surfaces were scratched. Then, each regenerated elastic roller was used for experiments on image formation and image evaluation under the same conditions as those in Example 1, to evaluate the quality of each regenerated elastic roller. The results obtained are shown in Table 8.

TABLE 8

| Example: | Elastic roller | NCO equivalent weight | Aggluti-nated stain with or without cracks | Ghosts | Fog-ging | Surface with or without scratches |
|---|---|---|---|---|---|---|
| 10-1 | A-10-1 | 1.1 | with | A | A | without |
| 10-2 | A-1 | 1.2 | with | A | A | Without |
| 10-3 | A-10-2 | 1.5 | with | A | A | without |
| 10-4 | A-10-3 | 1.6 | with | B | B | without |

As shown in Table 8, it is seen that the regenerated elastic rollers having elastic layers composed primarily of the resin obtained by mixing the polyurethane polyol prepolymer and the isocyanate in the proportions of from 1.1 to 1.6 in NCO equivalent weight are sufficiently durable to repeated regeneration processing.

Example 11

The part(s) by mass of urethane resin particles (C400 Transparent; particle diameter: 14 μm; available from Negami Chemical Industrial Co., Ltd.) to be incorporated in raw-material fluids for forming surface layers of elastic rollers was changed as shown in Table 9. Then, elastic rollers (A-11-1, A-11-2, A-11-3 and A-11-4) each having surface roughness Ra as shown in Table 9 were produced. Regenerated elastic rollers were produced and evaluated in the same way as in Example 1 except that these elastic rollers were used. The results obtained are shown in Table 9.

TABLE 9

| Example: | Elastic roller | Part(s) by mass of urethane resin particles | Ra (μm) | Aggluti-nated stain with or without cracks | Ghosts | Fog-ging |
|---|---|---|---|---|---|---|
| 11-1 | A-11-1 | 1 | 0.03 | with | B | A |
| 11-2 | A-11-2 | 5 | 0.05 | with | A | A |
| 11-3 | A-11-3 | 15 | 1.1 | with | A | A |
| 11-4 | A-11-4 | 30 | 2.5 | with | A | A |

As shown in Table 9 above, regenerated elastic rollers with a higher grade can be obtained in Examples 5-1 to 5-5 in which the elastic roller surface roughness Ra is 0.05 to 2.5 μm.

Example 12

The surface roughness Ra of the pressing roller surface was changed by controlling the time for which the roller was ground by means of a cylindrical grinder, to produce pressing rollers (B-12-1, B-12-2 and B-12-3) each having surface roughness Ra as shown in Table 10. The pressing roller (B-1) was also produced in the same way as in Example 1. In the same way as in Example 1 except that these pressing rollers were used, thirty regenerated elastic rollers were produced for each pressing roller. The regenerated elastic rollers produced 30th were evaluated in the same way as in Example 1, and were visually observed on whether or not their surfaces were scratched. The results obtained are shown in Table 10.

TABLE 10

| Example: | Pressing roller | Ra (μm) | Aggluti-nated stain with or without cracks | Ghosts | Fog-ging | Surface with or without scratches |
|---|---|---|---|---|---|---|
| 12-1 | B-12-1 | 0.05 | with | A | B | without |
| 12-2 | B-1 | 0.1 | with | A | A | without |
| 12-3 | B-12-2 | 1.0 | with | A | A | without |
| 12-4 | B-12-3 | 5.0 | with | A | A | without |

From the results shown in Table 10, it is seen that setting the pressing roller to be 0.1 to 5 μm in surface roughness Ra is advantageous to the production of high-quality regenerated elastic rollers.

Example 13

Production of Elastic Roller (A-13)

The following materials were mixed using an open roll mill to prepare an uncured rubber composition.

Epichlorohydrin-ethylene oxide-ally glycidyl ether terpolymer (trade name: EPICHLOMER CG102; available from Daiso Co., Ltd.): 100 parts by mass.

Zinc stearate as a processing auxiliary: 1 part by mass.

Zinc oxide as a vulcanization accelerating auxiliary: 5 parts by mass.

MT carbon black (trade name: THERMAX N990; available from Cancarb Technologies Ltd.) as filler: 30 parts by mass.

Dipentamethylenethiram tetrasulfide (trade name: NOCCELER TRA; available from Ouchi-Shinko Chemical Industrial Co. Ltd.) as a vulcanizing agent: 2 parts by mass.

Then, a tube of the above uncured rubber composition was formed by extrusion using a vented extruder (a vented extruder of 50 mm in diameter, L/D: 16; manufactured by EM Giken Co.). Then, the tube obtained was put into a vulcanizer and was primarily vulcanized at a temperature of 160° C. for 30 minutes with application of pressurized water vapor to obtain a rubber tube of 15 mm in outer diameter, 5.5 mm in inner diameter and 250 mm in length.

Next, a mandrel of 256 mm in length and 6 mm in diameter was readied which was made of a free-cutting resulfurized steel (SUM) coated beforehand with a heat curable adhesive agent (trade name: METALOC U-20; available from Toyokagaku Kenkyusho Co., Ltd.) followed by drying. Then, this mandrel was inserted into the rubber tube and then heated at a temperature of 160° C. for 2 hours in a hot-air oven to secondarily vulcanize the rubber tube and bond the mandrel and the rubber tube together. The rubber tube was cut at both ends so as to be 224 mm in length in its axial direction. Thereafter, using an NC grinder, the rubber tube was so ground as to come into a crown shape of 12.00 mm in diameter at end portions of the rubber part and 12.10 mm in diameter at the middle portion of the rubber part.

Next, the following materials were mixed, and dispersed for 6 hours by means of a paint shaker to prepare a dispersion liquid.

Lactone modified acrylic polyol having a solid content of 70% and a hydroxyl value of 90% (trade name: PLACCEL DC2009; available from Daicel Chemical Industries, Ltd.): 150 parts by mass.

Methyl isobutyl ketone: 500 parts by mass.

Silicone oil (trade name: SH28PA; available from Dow Corning Toray Silicone Co., Ltd.) as a leveling agent: 0.05 part by mass.

Conductive tin oxide powder (trade name: SN-100P; available from Ishihara Sangyo Kaisha, Ltd.) as conductive particles: 30 parts by mass.

Non-cross-linked acrylic particles (trade name: M-200; available from Matsumoto Yushi-Seiyaku Co., Ltd.) as elastic particles: 30 parts by mass.

Then, the following materials were mixed, and stirred for 1 hour by means of a ball mill to prepare a surface layer coating fluid of 9 mP·s in viscosity.

The above dispersion: 370 parts by mass.

Isophorone diisocyanate, cyanurate type (trade name: BESTANATO B1370; available from Degussa-Hulls AG): 25 parts by mass.

Hexamethylene diisocyanate, cyanurate type (trade name: DURANATE TPA-B80E; available from Asahi Chemical Industry Co., Ltd.): 16 parts by mass.

The mandrel on the periphery of which the crown-shaped elastic layer was beforehand formed was immersed into the surface layer coating fluid, and drawn up at a rate of 300 mm/min, followed by air drying for 30 minutes. Subsequently, this mandrel was reversed in its axial direction, and was immersed again in the surface layer coating fluid, and drawn up at a rate of 300 mm/min. Then, the wet coating formed was dried at a temperature of 160° C. for 1 hour to form on the periphery of the elastic layer a surface layer of 20 μm in thickness. Thus, an elastic roller (A-13) of this Example was obtained.

The elastic roller (A-13) was set as a charging roller in an electrophotographic process cartridge for an electrophotographic image forming apparatus (trade name: Color Laser Jet 4700dn; manufactured by HP Ltd.). This was left standing for 24 hours in an environment of a temperature of 15° C. and a humidity of 10% RH. Thereafter, this electrophotographic process cartridge was mounted to the main body of the electrophotographic image forming apparatus, and in the environment of a temperature of 15° C. and a humidity of 10% RH, images of 1% in print percentage were reproduced until the remaining amount of the developer came to be 20 g, to thereby adhere the agglutinated stain of a developer origin to the charging roller surface.

The charging roller whose surface the agglutinated stain of a developer origin was adhered to was detached from the electrophotographic process cartridge, and air was blown against the surface to remove developer components therefrom. Thereafter, this roller surface was observed with a microscope to find that components coming from the developer were seen to adhere much to the roller surface.

A regenerated elastic roller was produced in the same way as in Example 1 except that this charging roller was used.

The regenerated elastic roller thus obtained was evaluated in the following way.

The regenerated elastic roller of this Example was set as a charging roller in an electrophotographic process cartridge for an electrophotographic image forming apparatus (trade name: Color Laser Jet 4700dn; manufactured by HP Ltd.). This electrophotographic process cartridge was left standing for 24 hours in an environment of a temperature of 15° C. and a humidity of 10% RH. Thereafter, this electrophotographic process cartridge was mounted to the main body of the electrophotographic image forming apparatus. In the environment of a temperature of 15° C. and a humidity of 10% RH, halftone images were reproduced as images for evaluation on charge lines.

If images are formed by using a charging roller whose surface the agglutinated stain of toner has been formed on, the charge quantity of toner on the photosensitive drum becomes short. If halftone images are formed in this state, the potential on the photosensitive drum may become non-uniform, so that charge lines may be formed. Accordingly, the level of such charge lines may be used as an index of how far the contamination of surface has been eliminated by the regeneration processing. As for charge lines resulting from contamination of the charging roller surface, image formation was carried out to make an evaluation according to the following criteria.

A: Charge lines are not seen at all in visual observation.

B: Charge lines are slightly seen.

C: Charge lines are clearly seen.

D: Many charge lines occur further in the lengthwise direction.

The results obtained are shown in Table 11.

Comparative Example 3

Image formation was carried out to make an evaluation in the same way as in Example 13 except that the charging roller whose surface the agglutinated stain of toner was formed on was not subjected to the regeneration processing. The results obtained are shown in Table 11.

Comparative Example 4

In the same way as in Example 13 except that the pressing roller was not set up, the regeneration processing was performed, and image formation was carried out to make an evaluation. The results obtained are shown in Table 11.

TABLE 11

| | Step(s) of regeneration processing carried out | Charge lines |
|---|---|---|
| Example 13 | First & second steps | A |
| Comparative Example 3 | Not carried out | C |
| Comparative Example 4 | Second step only | B |

It is seen from Table 11 above that the regenerated elastic roller according to the present invention is also usable as a charging roller.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priorities from Japanese Patent Application No. 2007-011914 filed on Jan. 22, 2007 and Japanese Patent Application No. 2008-008346 filed on Jan. 17, 2008, which are herein incorporated by reference.

What is claimed is:

1. A regenerated elastic roller manufacturing process comprising the step of removing an agglutinated stain of a developer origin adhered to the surface of an elastic roller, said elastic roller provided with a mandrel and an elastic layer, wherein said step comprises the steps of:

(1) rotatably supporting the elastic roller, a pressing roller and an adhesive roller in a jig, with the elastic roller positioned between the pressing roller and the adhesive roller;

(2) rotating the rollers;

(3) pressing the pressing roller against the surface of the elastic roller so as to crack the agglutinated stain which is kept in a hardened state on the surface of the elastic roller; and (4) removing the agglutinated stain cracked in the step (3) from the surface of the elastic roller by pressing the adhesive roller against the surface of the elastic roller;

wherein the elastic roller, the pressing roller and the adhesive rollers have diameters Da, Db and Dc respectively, which satisfy a relationship Dc<Da<Db.

2. The regenerated elastic roller manufacturing process according to claim 1, wherein the elastic roller, the pressing roller and the adhesive roller have Asker-C hardnesses Ha, Hb and Hc, respectively, which satisfy a relationship of Hc<Ha<Hb.

3. A regenerated elastic roller manufacturing process comprising the step of removing a laminar agglutinated stain of a developer origin adhered to the surface of an elastic roller, said elastic roller provided with a mandrel and an elastic layer as a surface layer, wherein said step comprises the steps of:

(1) rotatably supporting the elastic roller, a pressing roller and an adhesive roller in a jig, with the elastic roller positioned between the pressing roller and the adhesive roller;

(2) rotating the rollers;

(3) locally deforming the elastic roller on the surface of which the laminar agglutinated stain whose flexibility is lower than the elastic roller has been adhered, by pressing the pressing roller against the surface of the elastic roller, and cracking the agglutinated stain which is kept in a hardened state, and (4) removing the agglutinated stain cracked in the step (3) from the surface of the elastic roller by pressing the adhesive roller against the surface of the elastic roller;

wherein the elastic roller, the pressing roller and the adhesive roller have diameters Da, Db and Dc respectively, which satisfy a relationship Dc<Da<Db.

* * * * *